United States Patent [19]

Hill et al.

[11] 3,956,982

[45] May 18, 1976

[54] BUNDLE FORMING APPARATUS

[75] Inventors: William J. Hill; William R. Wynn, both of Holden, Mass.

[73] Assignee: Morgan Construction Company, Worcester, Mass.

[22] Filed: Nov. 29, 1974

[21] Appl. No.: 528,135

Related U.S. Application Data

[63] Continuation of Ser. No. 346,632, March 30, 1973, abandoned.

[52] U.S. Cl. ..... 100/212; 100/7; 53/162; 53/236; 214/6 H

[51] Int. Cl.[2] ..... B30B 5/04

[58] Field of Search ..... 214/6 DK, 6 H, 6 D, 214/6 N, 6.5; 100/7, 212; 53/148, 162, 236

[56] References Cited

UNITED STATES PATENTS

| | | | |
|---|---|---|---|
| 987,740 | 3/1911 | Peterman | 100/212 |
| 3,427,959 | 2/1969 | Keil | 100/212 |
| 3,531,001 | 9/1970 | Lunden | 214/6 DK |
| 3,599,807 | 8/1971 | Hedrick et al. | 214/5 DK X |

*Primary Examiner*—L. J. Paperner

*Attorney, Agent, or Firm*—Thompson, Birch, Gauthier & Samuels

[57] ABSTRACT

An apparatus for receiving a plurality of elongated elements and for forming the same into a densely packed assembly. The apparatus may be mounted on a carriage which extends longitudinally in a direction parallel to the lengths of the elements being handled, and which is movable laterally along tracks or rails. The apparatus includes a plurality of pairs of cooperating arms spaced along the length thereof. Each pair of arms has a chain associated therewith, the latter being supported on appropriately positioned sheaves carried by the arms. One of the arms of each pair is preferably movable relative to the other arm between an open position to laterally receive the elongated elements therebetween for deposit on the aforesaid chains, and a closed position. The chains are initially adjusted to form bridging catenaries onto which the elements are transferred. Thereafter, the chains are gradually slackened by reciprocally operable mechanisms to form slings into which the elements introduced between the arms are received. Upon closure of the movable arms, the chains are tightened, thereby densely packing the assembled elements. The carriage is then moved laterally to another location where the densely packed elements are strapped or tied into bundle form, and then to still another location where the bundle is transferred to another handling apparatus.

6 Claims, 11 Drawing Figures

BUNDLE FORMING APPARATUS

This is a continuation of application Ser. No. 346,632, filed Mar. 30, 1973, now abandoned.

DESCRIPTION OF THE INVENTION

This invention relates generally to the art of material handling, and in particular to a novel and improved apparatus for handling elongated elements, for example bars and the like produced by a rolling mill.

It is an object of the present invention to provide an apparatus for receiving a plurality of elongated elements at one location and for forming the same into a densely packed assembly. The apparatus may be mounted on a carriage which operates to transfer the assembly of elements to other locations for subsequent processing or handling. The carriage is movable laterally along tracks or rails in a direction transverse to the lengths of the elements being handled. The apparatus includes a plurality of pairs of cooperating arms spaced along the length thereof. Each pair of arms has a chain associated therewith. One of the arms of each pair is preferably movable relative to the other arm between an open position to laterally receive the elongated elements on the aforesaid chains, and a closed position. The chains are initially adjusted to form bridging caternaries onto which the elements are transferred. Thereafter, the chains are gradually slackened by reciprocally operable mechanisms to form slings into which the elements are received. Only enough chain is payed out to accommodate the cross-section of the elements. The shape of the elements in the chain slings lends itself to be densely packed into a near circular bundle cross-section with minimum motion between individual elements. Upon closure of the movable arms, the chains are tightened, thereby densely packing the assembled elements. The carriage is then moved laterally to another location where the densely packed elements are strapped or tied into bundle form, and then to still another location where the bundle is transferred to other apparatus.

Another object of the present invention includes the provision of unique reeving arrangements for guiding the chains, and unique reciprocally operable mechanisms for tightening the chains after the elements have been received thereon, the said reeving arrangements and mechanisms being effective to prevent the chains from being pulled across the elements. This is advantageous in that it avoids scraping or marking of the elements in contact with the chains. A further object of the present invention is to avoid causing the chains during the tightening thereof. This allows heavier and wider chains to be employed, and thus enables the apparatus to exert a greater restraining force on the elements prior to strapping the same into bundle form. The wider chains distribute their restraining force over a greater area and thus permit the greater restraining force to be exerted without damage to the elements. Still another object of the present invention is to provide an apparatus which is capable of operating substantially automatically with minimum attention required by operating personnel, and which is easily adaptable to a wide range of product types and sizes.

These and other objects and advantages of the present invention will become more apparent as the description proceeds with the aid of the accompanying drawings wherein.

Figure 3:
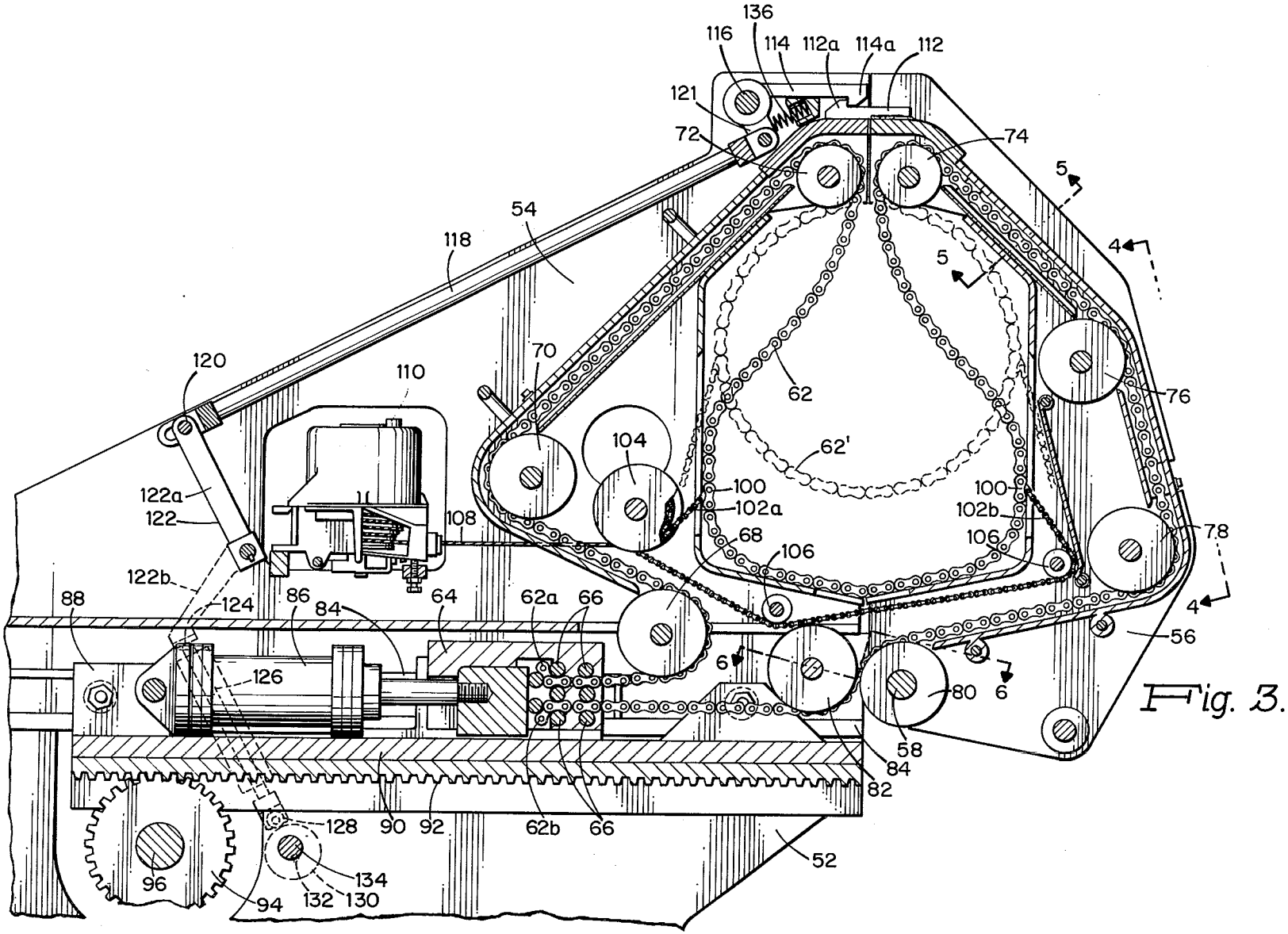
FIG. 3 is an enlarged view taken transverselly through the carriage, with portions of a pair of cooperating arm members and the carriage base broken away in order to provide a better illustration of interior components.
Figure 4:
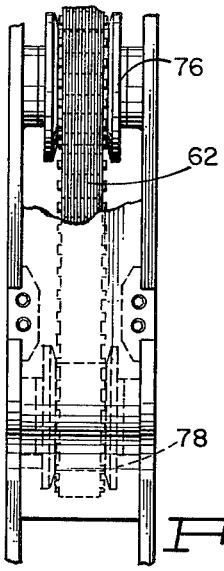
Figure 5:
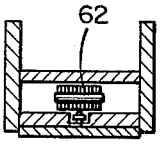
Figure 6:
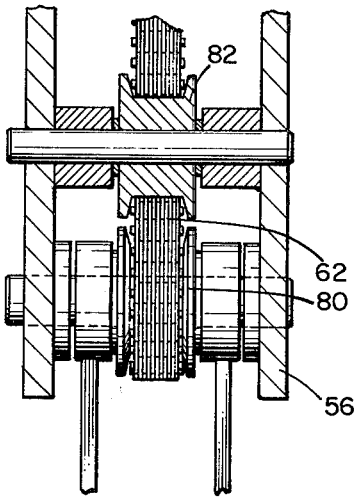
Figure 7:
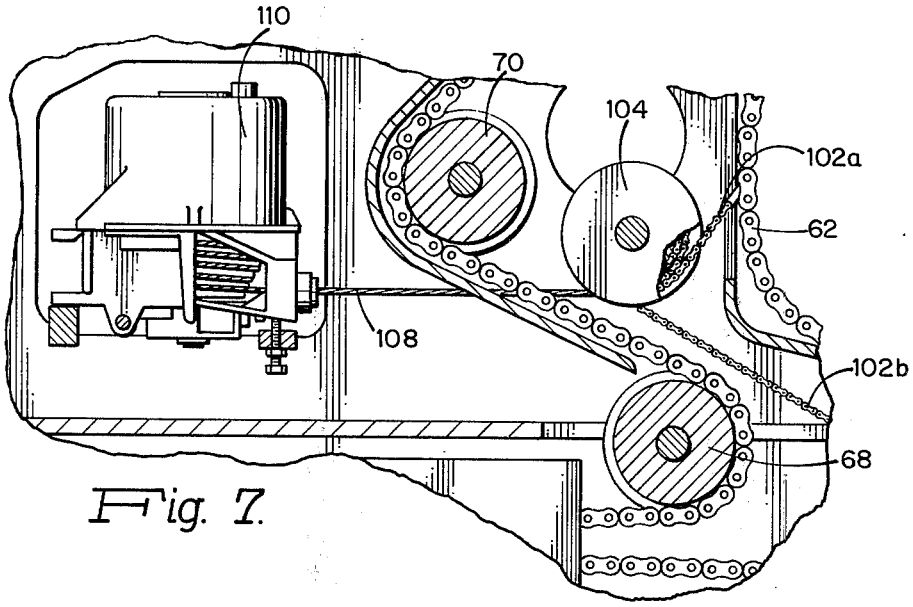
Figure 8:
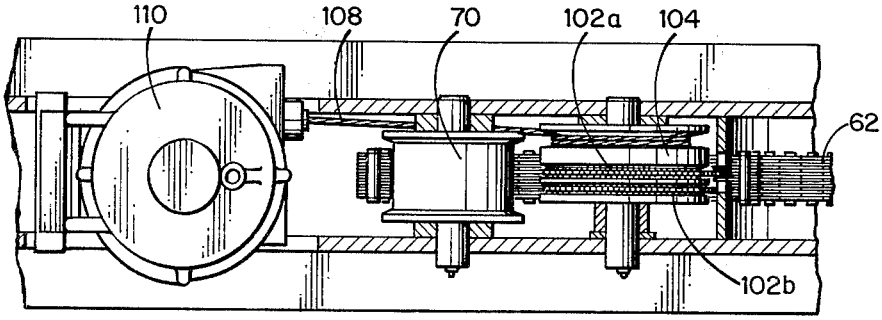
Figure 9A:
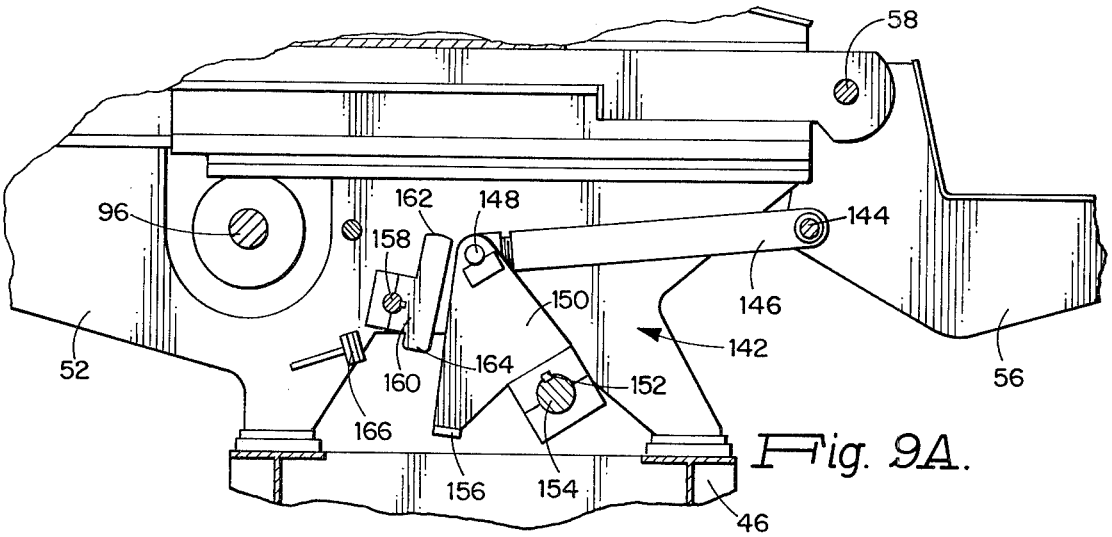
Figure 9B:
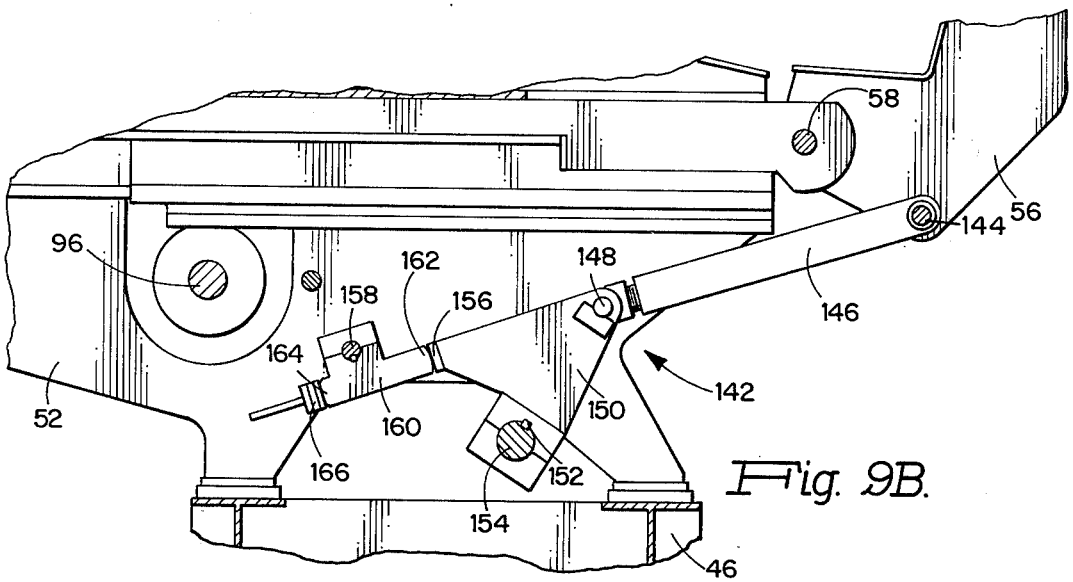
Figure 9C:
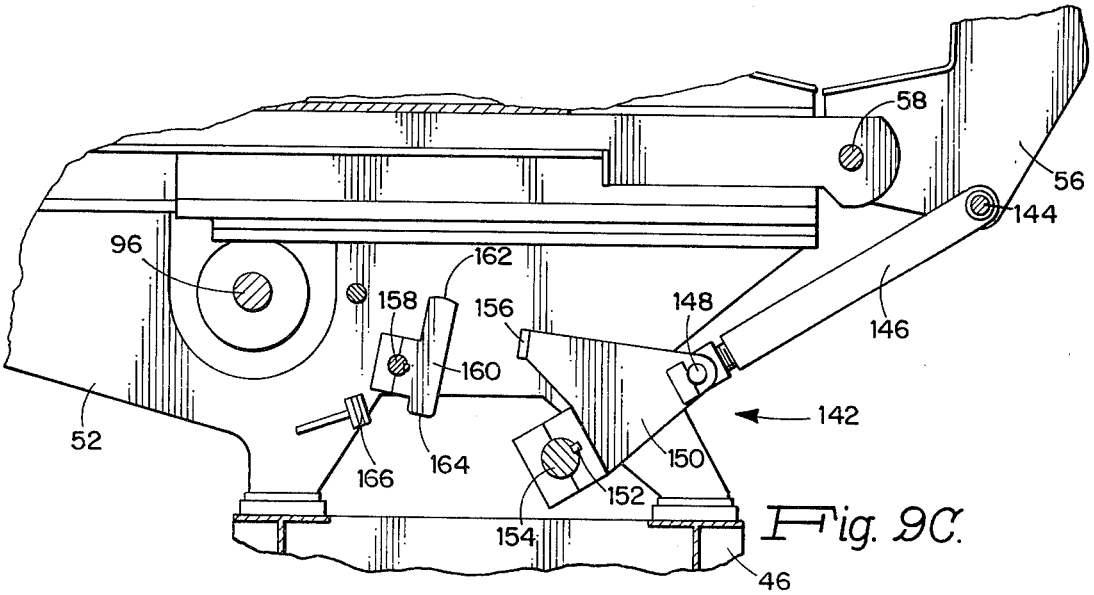

FIGS. 4, 5 and 6 are views taken along lines 4—4, 5—5 and 6—6 respectively of FIG. 3;

FIG. 7 is an enlarged view of the spring loaded chain retractor which is employed to urge each chain away from the strapped bundle when the latter is being removed from the apparatus;

FIG. 8 is a plan view of the chain retractor shown in FIG. 7; and,

FIGS. 9A–9C are views showing the operation of the means employed to pivotally adjust the movable arms in relation to the fixed arms.

Figure 1:
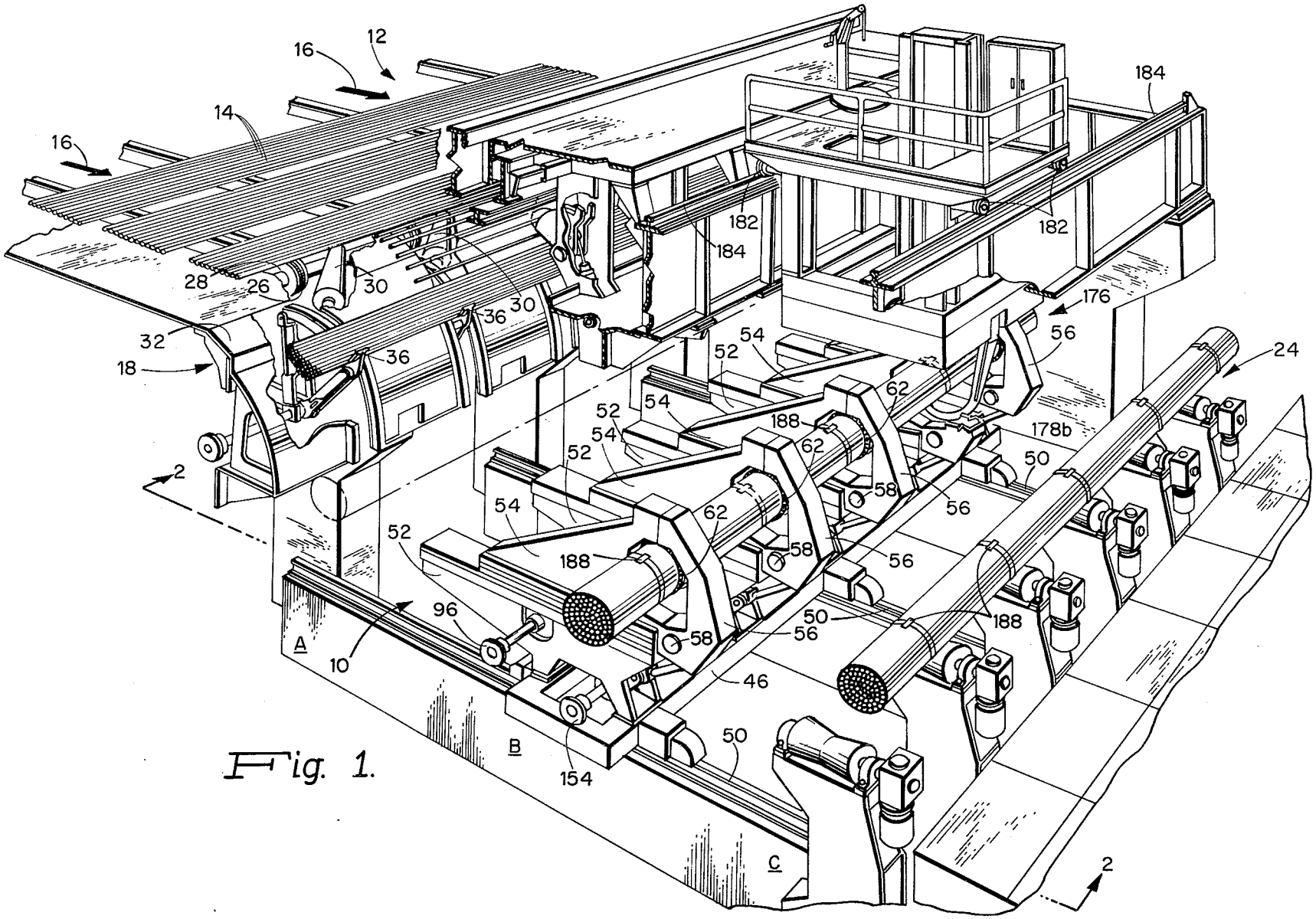
FIG. 1 is a view in perspective of an apparatus embodying the concepts of the present invention.
Figure 2:
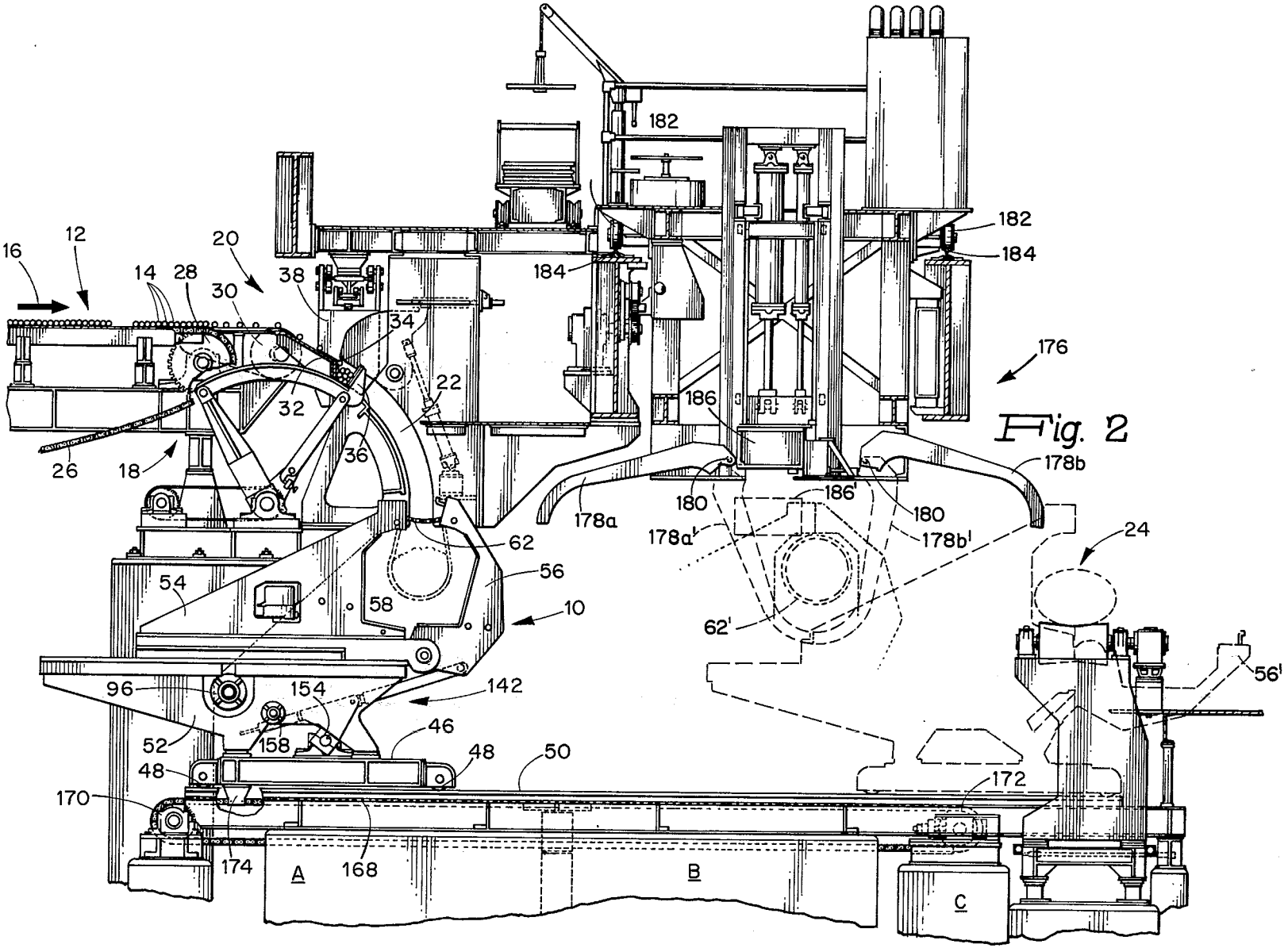
FIG. 2 is a view taken generally along the lines 2—2 of FIG. 1.

Referring now to the drawings wherein like members designate the same parts throughout the several views, and with reference initially to FIGS. 1 and 2, there is shown at 10 a transfer apparatus embodying the concepts of the present invention. The transfer apparatus 10 is shown in relation to an element transfer table 12 which receives elongated elements indicated typically at 14 and which carries the elements laterally in the direction indicated by arrows 16 to an assembly apparatus generally indicated at 18. While moving laterally from the table 12 into the assembly apparatus 18, the ends of the elongated elements, which incidentally have been previously cut to length before being deposited on table 12, are aligned by an end alignment apparatus generally indicated at 20. The assembly apparatus 18 assembles the elements 14 at the upper end of an assembly and transfer zone 22, and then transfers the assembled elements downwardly to the lower end of the zone, at which location the assembled elements are received by the transfer apparatus 10 of the present invention. From here, the apparatus 10 operates to densely pack the assembled elements and to transfer the same through a strapping operation before finally depositing the resulting bundle on a bundle conveyor generally indicated at 24.

The element transfer table 12 includes driven transfer chains 26 running over sprocket wheels 28. The elements 14 are carried laterally on the chains 26 to the delivery end of the the table, where rotatably driven separating rolls 30 receive the elements and accelerate the lateral transfer thereof to thus provide a lateral spacing between the elements before they move past the end alignment apparatus 20 and into the assembly apparatus 18.

The end alignment apparatus 20 is the subject of a separate application being filed concurrently herewith, Ser. No. 346,460, now U.S. Pat. No. 3,902,586, and entitled "END ALIGNMENT APPARATUS". Likewise, the assembly apparatus 18 is also the subject of another separate application filed concurrently herewith, Ser. No. 346,685, now U.S. Pat. No. 3,837,465 and entitled "ASSEMBLY AND TRANSFER APPARATUS". Both of these other applications are assigned to the same assignee as that of the present application Accordingly, it will be understood that both the end alignment apparatus 20 and the assembly apparatus 18 will be referred to only briefly in the following description for the purpose of providing an introduction to the more detailed description of the transfer apparatus 10 which is the main subject of the present application.

As the elements 14 leave the separating rollers 30, they move down an inclined ramp 32, through an opening 34 and into the assembly and transfer zone 22 where they accumulate against carrier members 36. The opening 34 is preferably adjustable to admit the elements laterally and singly into the zone 22. The end alignment apparatus 20 has opposed paddles 38 (only one being shown in FIG. 2) which cooperate reciprocally to align the ends of the elements as they move down the ramp 32 and into the zone 22. The carrier members 36 are moved downwardly along the zone 22, initially to provide a gradually increasing space within which the elements being received from the table 12 are assembled, and thereafter to move the assembled elements downwardly in a controlled manner to the bottom end of the zone where they are received by the transfer apparatus 10 of the present invention.

The transfer apparatus 10 includes a carriage 46 which is provided with wheels 48 arranged to run along rails 50. The rails extend from an element receiving station A underlying the bottom end of zone 22 through a strapping station B to a delivery station C. The carriage 46 extends longitudinally in parallel relationship to the elements 14 being assembled by the assembly apparatus 18. A plurality of upstanding base structures 52 are spaced along the length of and form a part of the carriage 46. Each base structure 52 supports a pair of cooperating arms 54 and 56. The arms 54 are fixed, and the arms 56 are pivotally mounted as at 58 for movement relative to the fixed arms 54.

A restraining chain 62 is associated with each pair of arms 54 and 56. As is best shown by a combined reference to FIGS. 3–8, one end 62*a* of the chain is contained within and fixed relative to the cross-head 64 by removable transverse pins indicated typically at 66. From end 62*a*, the chain extends around a sheave 68 on the base 52. From sheave 68, the chain passes upwardly at an angle to the sheave 70 carried by the fixed arm 54, then to another sheave 72 supported at the upper end of the fixed arm 54. From here, the chain 62 extends between the arms to another sheave 74 at the upper end of the movable arm 56, and then down and around two other sheaves 76 and 78 also carried by the arm 56. The chain then passes between two additional opposed sheaves 80 and 82 on the base 52, the former of which is rotatable about the pivotal axis 58 of the adjustable arm 56. The other end 62b of the chain is also held within and fixed relative to the cross-head 64 by means of the transverse pins 66.

The cross-head 64 is guided on tracks 84 for movement laterally (to the left or right as viewed in FIG. 3) on base 52. The cross-head 64 is connected by means of an intermediate tensioning element 86, which preferably is of the spring type, to a bracket 88 which extends vertically from a slide 90. The slide is provided on its underside with a gear rack 92 which is in meshed relationship with a pinion gear 94 on a shaft 96, the latter extending the length of the carriage 46 and having other pinion gears thereon in meshed relationship with other slides on the other base structures 52. It will be understood that the arms 54 and 56 in each cooperating pair, and the sheaves carried thereon, are all located in a common plane. Hence, the chain 62 supported thereon is not crossed when the arm 56 is pivotally adjusted. This in turn permits the use of wide heavy restraining chains 62.

Each chain 62 is further connected at oppositely disposed points as at 100 to smaller light-weight chains 102*a* and 102*b*. Chain 102*a* is wrapped around and is seated in one groove of a multi-groove sheave 104. Likewise, chain 102*b* extends around small diameter idler sheaves 106 before being wrapped around and seated in another groove in sheave 104. The sheave 104 is in turn connected by a cable 108 to a spring-loaded retractor 110, for example model 300L manufactured by the Aero-Motive Manufacturing Company of Kalamazoo, Mich., U.S.A. The retrator 110 constantly urges the sheave 104 to rotate in a clockwise direction as viewed in FIG. 3, which in turn operates through chains 102*a* and 102*b* to pull the chain 62 downwardly towards the bottoms of the arms 54 and 56 as indicated by the solid lines in FIG. 3.

The upper end of arm 56 provided with a fixed latch member 112 having an upwardly protruding nose 112*a*. The upper end of arm 54 is likewise provided with a latch member 114 having a downturned nose 114*a* which cooperates in locked engagement with the nose 112*a* when the arm 56 is pivoted to the closed position as shown in FIG. 3. Latch member 114 is pivotally mounted by means of a pin 116, and is opened and closed by a reciprocally movable arm 118 which is connected at its upper end to a short arm 121 on the latch member 114, and at its lower end as at 120 to one arm 122*a* of the bell crank 122, the other arm 122*b* of which is acted upon as at 124 by a plunger 126 having a follower 128 engaging a rotatable cam 130. The cam 130 is keyed as at 132 to a shaft 134 extending the length of the carriage 46 and having other cams 130 acting in concert with identical arrangements on the other base structures 52. A spring 136 acts on the arm 121 to resiliently urge the latch member 114 to its down position as shown in FIG. 3.

The linkage arrangement which is generally indicated at 142 and which is employed to pivotally operate each of the arms 56 will now be described with reference to FIGS. 9A–9C. Each arm 56 is pivotally connected as at 144 to one end of an adjustable link 146, the other end of which is pivotally connected as at 148 to a crank 150. The crank 150 is keyed as at 152 to a shaft 154 which runs the length of the apparatus 10. Crank 150 has a laterally extending nose 156. Another shaft 158 has keyed thereto a rotatable stop 160 which is provided with oppositely disposed noses 162 and 164. A fixed stop 166 is also located on the base structure 52.

The shafts 154 and 158 extend the length of the apparatus and operate identical linkage arrangements associated with each arm 56. The linkage arrangement 142 operate to manipulate the arms 56 between the three basic positions shown in FIGS. 9A–9C. More particularly, in FIG. 9A, the arms 56 are shown fully lowered to their bundle delivery positions. When thus adjusted, both cranks 150 and the rotatable stop 160 have been rotated to their extreme counterclockwise positions.

When adjusting the arms 56 to the element receiving position as shown by the solid lines in FIG. 2, both the rotatable stops 160 and the cranks 150 are rotated in a clockwise direction to the positions shown in FIG. 9B. This brings the nose 156 on each crank 150 into contact with the nose 162 on the adjacent rotatable stop 160, while at the same time bringing the other nose 164 on the stop 160 into contact with the adjacent fixed stop 166. This condition is maintained while the elements are being received on the chains 62 which extend between the arms 54 and 56.

When the arms 56 are closed prior to tightening the chains 62, the cranks 150 are rotated further in a clockwise direction as shown in FIG. 9C. This brings the upper ends of the arms 56 into contact with the upper ends of arms 54, and causes the latch members 112 and 114 to become engaged. In this condition, the rotatable stops 160 are inoperable and hence are returned in a counterclockwise direction to their original positions as shown in FIG. 9A.

At this point, it will be understood that the shafts 96, 134, 154 and 158 which all extend the length of the apparatus, are operated by means (not shown) carried by the carriage 46. The movement of the arms 56, the disengagement of the latching members 114 and the slackening or tightening of the chains 62 occurs in unison in response to common operating means.

The carriage 46 is moved laterally between stations A, B and C by means of one or more drive chains 168 running between sprockets wheels 170 and 172. Each chain 168 is connected to a dog 174 depending from the carriage. The chain, or chains 168, may be driven by known reversible means (not shown).

The apparatus of the present invention operates in the following manner: initially, the carriage assembly 46 is moved to the position shown by the solid lines in FIG. 2 at the element receiving station A. The movable arms 56 are adjusted to their partially open element receiving positions with their upper ends spaced laterally from the upper ends of the fixed arms 54, and with the chains 62 extending therebetween in a slightly slackened condition. The chains are thus located beneath the assembly and transfer zone 22.

After the elements 14 have been accumulated in the zone 22 against the carrier members 36, the latter are lowered down the zone to a level beneath that of the chains 62 with the result that the elements come to rest on the chains, thus freeing the carrier members for retraction from beneath the zone. Once this has been accomplished, shaft 96 is rotated in a clockwise direction as viewed in the drawings to move the slide 90 to the right. This causes an equal amount of chain 62 to be fed over each sheave 72 and 74, thereby forming a sling into which the elements are received from the assembly and transfer zone 22 and allowed to accumulate as shown in dotted at station A in FIG. 2.

After the elements have been received on the slackened chains 62, the carriage assembly 46 is moved laterally to station B underlying a strapping apparatus generally indicated at 176. At or prior to the time that the carriage assembly 46 reaches station B, the shaft 154 is rotated to its extreme clockwise adjustment to pivotally close the movable arms 56, thereby engaging the latch members 112 with the latch members 114. Also, the shaft 96 is rotated in a counterclockwise direction to retract the slides 90 and the cross-heads 64 carried thereon. This causes an equal amount of chain to be pulled over each of the upper sheaves 72 and 74, and thus forms the elements supported on the chains into a densely packed assembly. The tensioning elements 86 located between the cross-heads 64 and the brackets 88 on the slides 90 insure that an equal amount of tension is applied to each chain 62. When thus tightened, the chains are in the condition illustrated in dotted at 62' in FIGS. 2 and 3.

The strapping apparatus 176 includes cooperating strap tracks **178*a* and 178*b* which are pivotally mounted as at 180 to a carriage which is movable by means of wheels 182 along tracks 184. The strap tracks are movable to operative positions indicated in dotted in FIG. 2 at 178*a'* and 178*b'*. The strapping apparatus 176 further includes a strapping head 186 which is movable downwardly to a position indicated in dotted at 186' to thus cooperate with the lowered strap tracks 178*a* and 178*b* to apply restraining straps 188 to the elements being supported in a densely packed condition on the chains 62. The strapping apparatus 176 is movable along rails 184** and is thus capable of applying as many straps as are required.

After the strapping operation has been completed, the strap tracks **178*a* and 178*b* and the strapping head 186 are raised to their inoperative positions. Thereafter, the carriage assembly 46 is moved laterally to station C, and the shaft 134 is rotated through one revolution to disengage the latch member 114 from the latch member 112. Once this has been accomplished, the shaft 154 is rotated to its extreme counterclockwise position (as indicated in FIG. 9a) to lower the arms 56 to the positions indicated in dotted at 56' in FIG. 2. While this is occurring, the shaft 96 is also rotated in a clockwise direction to move the slides 90 to the right and thus slacken the restraining chains 62. As the chains 62 are slackened, the retractors 10 operate through cables 108 and chains 102*a* and 102*b* to retract the chains 62 from the bundle. The bundle is thus deposited on the bundle conveyor 24 in the position indicated in dotted in FIG. 2. The bundle conveyor 24 is then operated to move the bundle longitudinally to another location while the carriage 46** is returned to station A.

In light of the foregoing description, it will now be more evident to those skilled in the art that the transfer apparatus 10 of the present invention embodies a number of unique advantageous features. For example, the reeving arrangement for the chains 62 insures that an equal amount of chain is always payed out over each of the opposed sheaves 72 and 74. This avoids dragging or scraping the chain across the elements supported thereon. The arms 54 and 56 in each cooperating pair, and the sheaves associated therewith, are all in the same plane, thus avoiding the necessity of crossing the chains 62. This permits wider heavier chains to be employed, and thus allows the apparatus to exert a greater restraining action on the elements. Because the chains are wider, the restraining force is spread over a greater area and hence pinching of the elements is avoided. The use of retractors 110 and their associated cables 108 and chains 102A and 102b insures that the restraining chains 62 are pulled out of the way when the strapped bundles are deposited on the bundle conveyor 24.

Having thus described a preferred embodiment of an apparatus embodying the concepts of the present invention, it will now be appreciated by those skilled in the art that numerous modifications may be made without departing from the spirit and scope of the invention. For example, where it is desired to axially rather than laterally introduce the elements into the apparatus, and to also axially rather than laterally remove the strapped bundle, the cooperating arms which support the restraining chains and their respective sheaves may be fixed and if desired, permanently interlocked. Alternatively, both arms may be pivotally mounted. Steel cables may be employed instead of chains. The apparatus may be stationary instead of being mounted on a carriage.

It is accordingly, our intention to cover all changes and modifications of the embodiment herein chosen for purposes of disclosure which do not depart from the spirit and scope of the invention.

We claim:

1. Apparatus for receiving elongated elements and for forming the same into a densely packed assembly, said apparatus comprising:

a. a base extending longitudinally in a direction parallel to the lengths of the elongated elements being handled;

b. a plurality of element receiving assemblies supported on and spaced along the length of said base, each of said assemblies including:

i. first and second upwardly extending arm members located in a plane transverse to the longitudinal axis of said base, at least one of said arm members being adjustable relative to the other arm member between an open position at which the upper ends of said arm members are spaced to laterally admit elongated elements therebetween, and a closed position at which the upper ends of said arm members are interconnected by a latch mechanism;

ii. first and second rotatable idlers at the upper ends respectively of said first and second arm members;

iii. a head member movable reciprocally relative to said first and second arm members;

iv. an elongated flexible restraining element extending from said head member over said first and second rotatable idlers and back to said head member, with the portion of said restraining element between said idlers forming a catenary extending between said first and second arm members;

c. first operating means for simultaneously adjusting the arm members of each element receiving assembly between said open position for receiving elements on said catenaries and said closed position preparatory to forming said elements into densely packed assemblies; and, d. second operating means for simultaneously reciprocating the head members of said element receiving assemblies, movement of said head members in one direction causing said catenaries to be lengthened for receiving elongated elements thereon, and in the opposite direction for shortening said catenaries to form said elongated elements into tightly packed assemblies.

2. The apparatus as claimed in claim 1 wherein said first operating means includes an elongated rotatable shaft extending in a direction parallel to the longitudinal axis of said base, and linkage means for connecting said shaft to one of the arm members of each of said element receiving assemblies.

3. The apparatus as claimed in claim 1 wherein said second operating means includes a rotatable shaft extending longitudinally in a direction parallel to the longitudinal axis of said base, and pinion gears carried on said shaft in meshed relationship with rack members connected to said head members.

4. The apparatus as claimed in claim 1 further characterized by means connected to said restraining elements for maintaining said catenaries in an open position.

5. The apparatus as claimed in claim 1 wherein said base is mounted on tracks for movement therealong in a direction transverse to the longitudinal axis of said base.

6. Apparatus for receiving elongated elements and for forming the same into a densely packed assembly, said apparatus comprising:

a. a base extending longitudinally in a direction parallel to the lengths of the elongated elements being handled, said base being movable transversely;

b. a plurality of element receiving assemblies supported on and spaced along the length of said base, each of said assemblies including:

i. first and second upwardly extending arm members located in a plane transverse to the longitudinal axis of said base, said first arm member being fixed relative to said base and said second arm member being adjustable relative to said base and said first arm member between an open position at which the upper ends of said arm members are spaced to laterally admit elongated elements therebetween, and a closed position at which the upper ends of said arm members are interconnected by a latch mechanism;

ii. first and second rotatable idlers at the upper ends respectively of said first and second arm members;

iii. a head member movable reciprocally relative to said first and second arm members;

iv. an elongated flexible restraining element extending from said head member over said first and second rotatable idlers and back to said head member, with the portion of said restraining element between said idlers forming a catenary extending between said first and second arm members;

c. first operating means for simultaneously adjusting the second arm member of each element receiving assembly between said open position for receiving elements on said catenaries and said closed position preparatory to forming said elements into densely packed assemblies, said first operating means having an elongated rotatable first shaft extending in a direction parallel to the longitudinal axis of said base, with linkage means for connecting said first shaft to said second arm members; and, d. second operating means for simultaneously reciprocating the head members of said element receiving assemblies, said second operating means having an elongated rotatable second shaft parallel to the longitudinal axis of said base, with pinion gears carried by said second shaft in meshed relationship with rack members connected to said head members, movement of said head members in one direction causing said catenaries to be lengthened for receiving elongated elements thereon, and in the opposite direction for shortening said catenaries to form said elongated elements into tightly packed assemblies.

* * * * *